US005129161A

United States Patent [19]

Szarka

[11] Patent Number: 5,129,161

[45] Date of Patent: Jul. 14, 1992

[54] UV LIGHT SHUTTLE COVER

[75] Inventor: Sandor Szarka, Franklin Lakes, N.J.

[73] Assignee: Precision Screen Machines, Inc., Hawthorne, N.J.

[21] Appl. No.: 475,831

[22] Filed: Feb. 6, 1990

[51] Int. Cl.[5] ..... F26B 3/28

[52] U.S. Cl. ..... 34/4; 432/42; 432/55

[58] Field of Search ..... 34/4, 39, 41; 432/222, 432/175, 57.55, 53, 42

[56] References Cited

U.S. PATENT DOCUMENTS

| | | | |
|---|---|---|---|
| 3,733,709 | 5/1973 | Bassemir et al. | 34/4 |
| 3,745,307 | 7/1973 | Peek, Jr. et al. | 34/4 |
| 3,826,014 | 7/1974 | Helding | 432/42 |
| 3,831,289 | 8/1974 | Knight | 432/55 |
| 4,005,135 | 1/1977 | Helding | 34/4 |
| 4,783,908 | 11/1988 | Pabst | 34/4 |
| 4,882,853 | 11/1989 | Schaft | 34/4 |

*Primary Examiner*—Henry C. Yuen

*Attorney, Agent, or Firm*—Hopgood, Galimafde Kalil, Blaustein & Judlowe

[57] ABSTRACT

An apparatus, e.g., a screen printing machine or dryer, having a light fixture wherein one or more cover plates shuttle between an open position in which light may bathe and dry a nearby object and a closed position in which the light is blocked. As an article passes under a lamp mounted onto the fixture the cover plates slide open, and as the dried article departs, the plates slide shut. This apparatus is especially suited for use in conjunction with an ultraviolet lamp, to prevent the escape of UV light into the work environment.

21 Claims, 3 Drawing Sheets

UV LIGHT SHUTTLE COVER

BACKGROUND OF THE INVENTION

This invention relates to machines, such as screen printing machines and dryers, in which light is used to quickly dry a wet surface, e.g., where a multi-color printing process is employed. More specifically, the invention relates to a cover for an ultraviolet (UV) light source.

It is well-known in the printing art that when more than one print image is to be laid upon the same surface, it is necessary to dry the first image before carrying out the second printing step, to avoid smearing and other problems. One method which may be used with some print media is to flash-dry the image by exposure to UV light. Typically, the article subject to printing is moved from a printing station to a UV drying station and then onward to the next printing station. Alternatively, a separate UV drying apparatus may be used in conjunction with a printing machine.

It is the nature of UV light sources that they require a significant period of time to warm up; thus, it is not possible to simply turn them on when an article is ready for UV exposure and then turn them off. A UV light source must remain on if high-speed efficiency is to be achieved in the printing process.

When an article is being exposed to the UV light, the article blocks the light and thereby protects nearby people and objects from exposure; at other times the light would flood the room if left uncovered. UV light, however, can be dangerous for workers who may be subject to exposure. Prolonged exposure can cause skin burns, skin cancer and optical damage. UV light may also bleach or otherwise damage inanimate objects. Consequently, it is important to cover the UV light source during the periods when an article is not directly beneath the UV lamp.

One method for covering the UV lamp is to use a retractable hood. The hood is retracted into an open position for exposure of the article and is closed at other times. These hoods are not adapted for gradual or timed exposure; they have only two positions, open or closed, and are mechanically complicated and thereby expensive to manufacture and maintain. Another disadvantage of these hoods results from the high heat output of UV lamps; because of the heat, rising air currents are produced which draw large quantities of dust and dirt up into the hood. As a result, the hoods require frequent cleaning, perhaps as often as several times a day; unfortunately, the complicated hood mechanism makes cleaning difficult and time-consuming.

SUMMARY OF THE INVENTION

This invention comprises an apparatus having a light fixture for holding a light source, e.g. an ultraviolet lamp, and a means for transporting an article which is to be exposed to light into a position proximate to the light source where exposure may take place, wherein one or more cover plates are mounted to the apparatus frame between the source and the transportation means, each cover plate having its own associated drive system for slidably translating the plate between a closed position blocking the light and an open position in which light bathes any article in position for exposure.

Two or more cover plates may slide together to fully block the light. When an article is being transported into position for exposure, one cover plate may begin to open before the other; similarly, the plates may close at different times when the article is moving out of position This ability to open and close independently makes possible an automated UV shuttle cover system wherein an activation means responsive to the position of an article or pallet causes the drive means of each cover plate to move in a timed sequence to smoothly and efficiently expose an article as it passes the UV light source.

OBJECTS OF THE INVENTION

One object of the present invention is to provide a shuttle cover for a UV light source.

Another object of this invention is to provide a light cover which may be easily and inexpensively manufactured and maintained.

Still another object of this invention is to provide a means for rapidly, efficiently and safely drying articles by UV light.

A further object of the present invention is to provide a printing machine which is capable of rapidly performing the steps of printing a design upon an article, moving the article to a drying station, and drying the article under UV light.

Yet another object of the invention is to provide a UV shuttle cover which may be easily cleaned.

Other objects and advantages of the present invention will be apparent to those skilled in the art from the following description and from the drawings.

DESCRIPTION OF THE PREFERRED EMBODIMENTS

Figure 1:
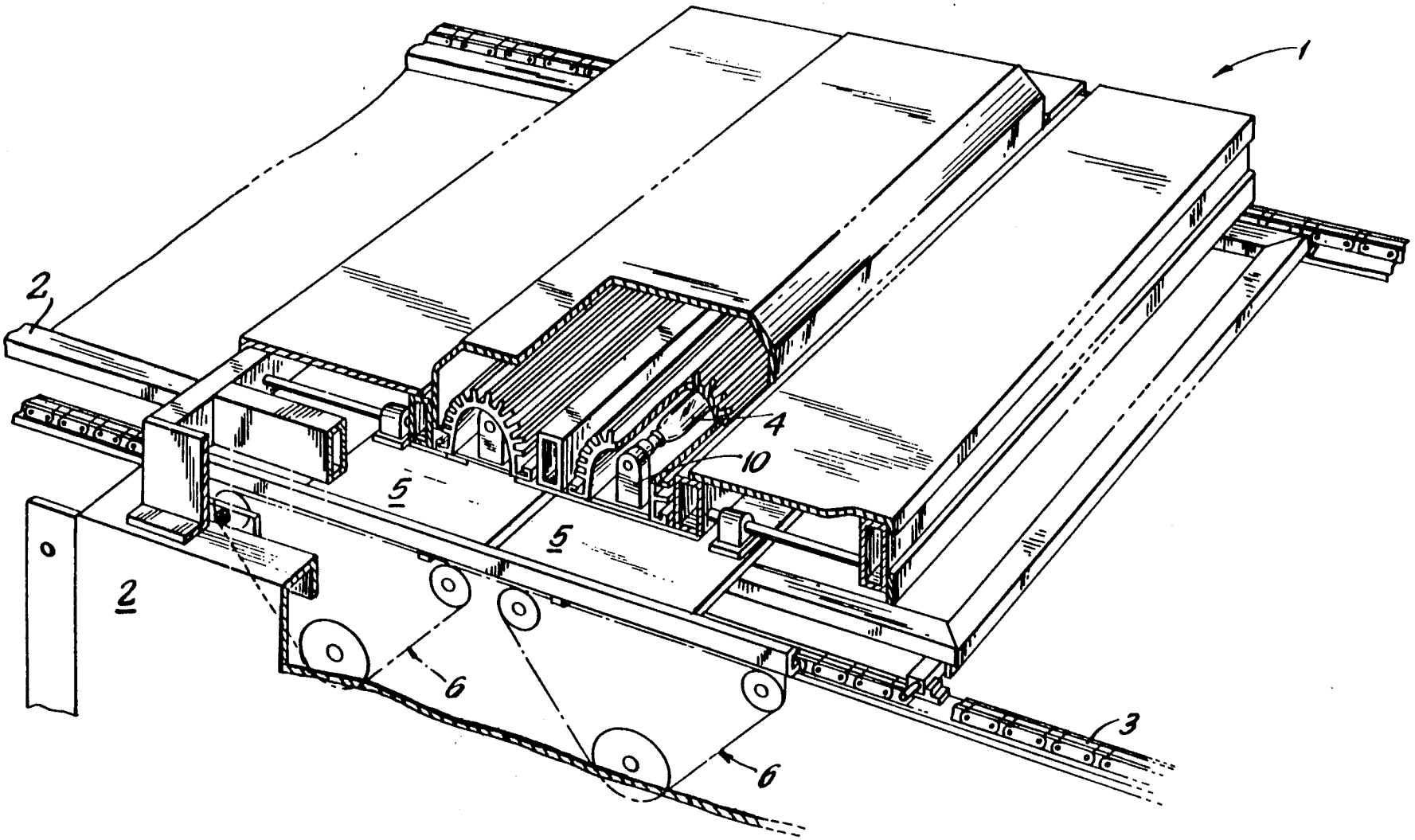
FIG. 1 is a perspective view of a UV shuttle cover apparatus according to this invention.
Figure 2:
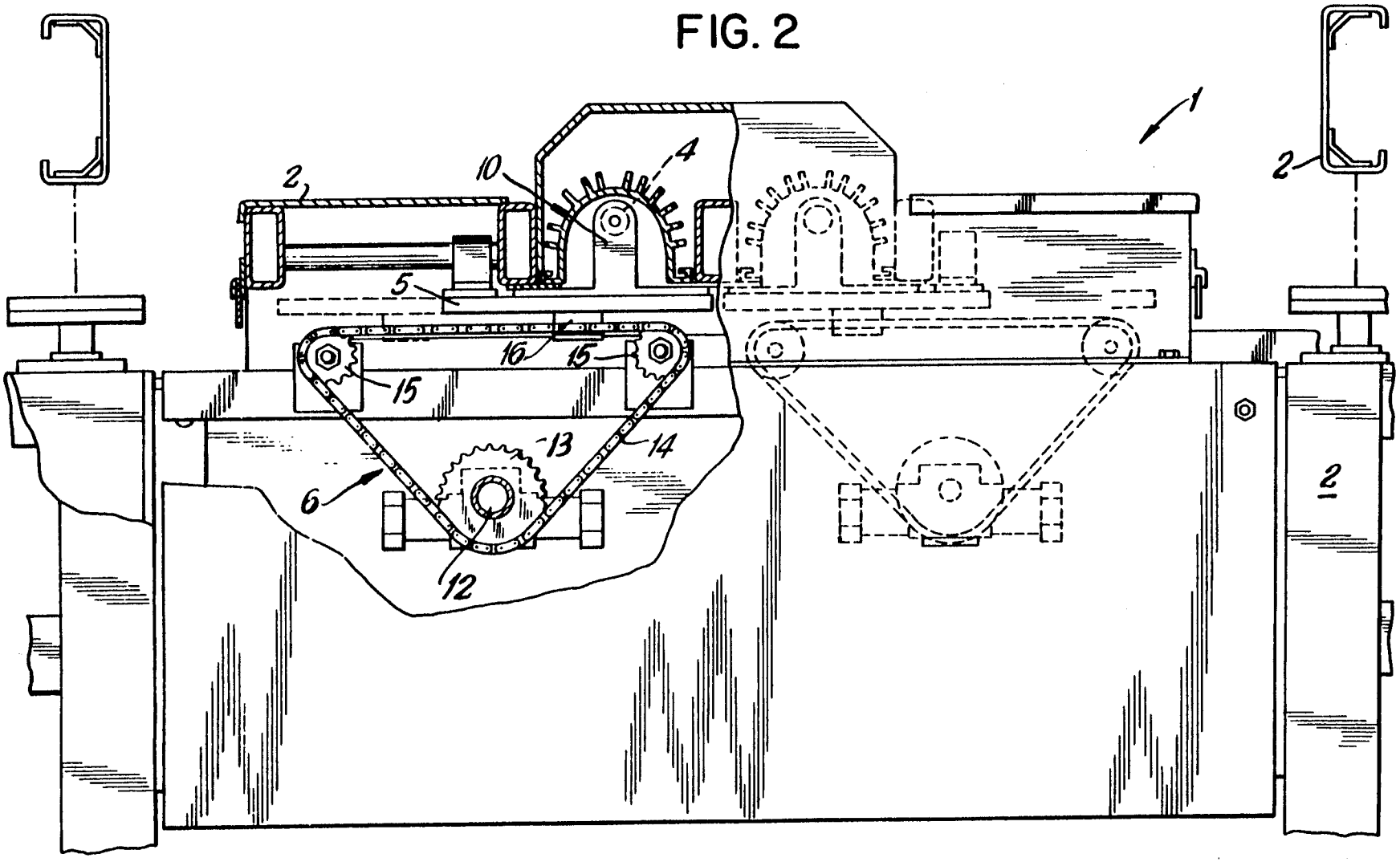
FIG. 2 is a side elevation of the UV shuttle cover apparatus of FIG. 1 partially illustrating the interior mechanism.
Figure 3:
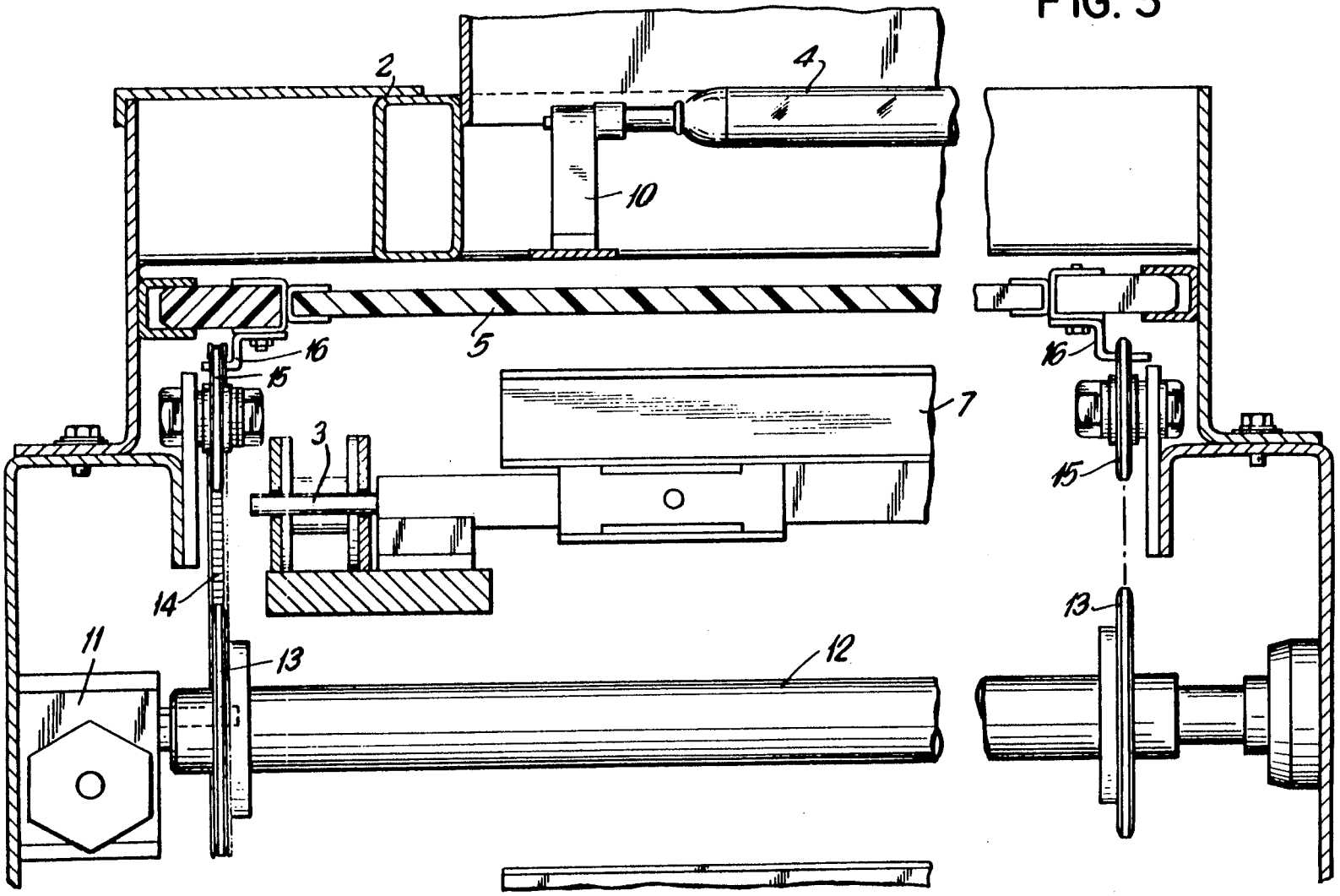
FIG. 3 is a cut-away elevation of the end of the shuttle cover apparatus of FIG. 2.

FIGS. 1-3 depict a preferred embodiment of the UV shuttle cover apparatus 1 of the present invention in which the frame 2 supports a transportation means 3 for moving articles to a drying station having a UV light source 4 mounted on a fixture 10. As an article moves into position under the lamp 4, the UV shuttle cover plates 5 slide open in timed sequence with the movement of the article so that the UV light bathes and dries the article. When the article moves away from the UV light drying station, the shuttle cover plates 5 slide together to block the UV light rays from escaping into the work environment.

Each shuttle cover plate 5 is operatively linked to a drive system 6 mounted on the frame 2. The drive systems 6 operate in response to an activation means responsive to the position of the article. The article may rest upon a pallet 7 which may directly interact with the activation means. The activation means may be any suitable means known in the art, e.g., a mechanical, photosensitive or electronic switch which is tripped by an approaching pallet 7 or article.

The drive systems 6 operate independently of each other so that the plates 5 may open and close independently; this makes it possible for the plates 5 to move in a timed or programmed sequence in which the plate nearest the approaching article will open first, while the opening of the other plate will delayed. In this sequence, the first plate 5 to open will be the first to close as the article moves away.

The drive system 6 comprises a rotary actuator 11 mounted on the frame 2, a torque member 12 rotatably driven by the actuator 11, a drive sprocket 13 engaging the torque member 12, a continuous loop drive chain 14 engaging the sprocket 13, and one or more idler rollers 15 mounted on the frame 2 to guide the chain 14. It is preferred to have a pair of sprockets 13 on each side of the plate 5, each driven by the same torque member 12, and each driving a chain 14 and two idler rollers 15. Connecting members 16 link the plate 5 to the chain 14 so that the plate 5 slides when the chain 14 moves.

Further explanation of the drive system is unnecessary, since the aforesaid components are well-known to those skilled in the art. The present invention is not limited to a particular type of drive system; any practical mechanism may be employed to move the cover plates as described and illustrated herein.

An apparatus according to the present invention may have a single shuttle cover which slides open and closed, or may have two or more covers working in concert.

The shuttle cover apparatus of the present invention may comprise a screen printing machine in which the transportation means delivers a pallet-supported article to a printing station and subsequently to a UV drying station. However, it is understood that this invention may be employed with any machine having a light source, e.g. a dryer apparatus or the like.

Although the shuttle cover apparatus of this invention is primarily intended to be used in conjunction with an ultraviolet light source, it may also be used with a light source which is not ultraviolet, or which is only partly ultraviolet.

Many variations of this invention will occur to those skilled in the art. The present invention is not limited to the illustrative embodiments set forth herein, but encompasses all embodiments consistent with the foregoing disclosure and falling within the scope of the appended claims.

What is claimed is:

1. An apparatus comprising:
- a frame;
- a fixture for holding a light source mounted to said frame;
- a transportation means mounted to said frame for transporting an article into a position proximate to said fixture in which positron exposure of the article to light may occur;
- a cover plate, slidably mounted to said frame between said fixture and said transportation means;
- a drive system mounted to said frame operatively linked to said cover plate and adapted to slide said linked cover plate between an open position in which exposure may occur and a closed position in which light is blocked by said cover plate; and
- an activation means responsive to the proximity of said article to said fixture, said drive system sliding the cover plate between its open and closed positions in response to said activation means.

2. An apparatus according to claim 1 wherein said fixture is adapted to receive an ultraviolet light source.

3. An apparatus according to claim 1 wherein said drive system comprises:
- a rotary actuator mounted on said frame;
- a torque member rotatably driven by said actuator;
- a drive sprocket engaging said torque member and rotated thereby;
- a continuous loop drive chain engaging said drive sprocket;
- one or more frame-mounted idler rollers guiding and supporting said chain; and
- a means for attaching said chain to said cover plate so that rotation of said drive sprocket and chain causes translation of said plate.

4. An apparatus according to claim 3 wherein said drive system further comprises: a second drive sprocket engaging said torque member; a second continuous loop chain engaging said second sprocket; a second set of frame-mounted idler rollers; and a means for attaching said second chain to said cover plate, said chains being connected to opposite sides of said cover plate.

5. An apparatus according to claim 3 wherein said drive system includes at least two idler rollers per chain.

6. An apparatus comprising:
- a frame;
- a fixture for holding a light source mounted to said frame;
- a transportation means mounted to said frame for transporting an article into a position proximate to said fixture in which positron exposure of the article to light may occur;
- a first cover plate and a second cover plate, each slidably mounted to said frame between said fixture and said transportation means;
- a drive system mounted to said frame operatively linked to said first cover plate and a second drive system mounted to said frame operatively linked to said second cover plate, each drive system adapted to slide said linked cover plate between an open position in which exposure may occur and a closed position in which light is blocked by said cover plate, said cover plates abutting each other when both are in the closed position to effectively block the light emanating from said source; and
- an activation means responsive to the proximity of said article to said fixture, each of said drive systems independently responsive to said activation means.

7. An apparatus according to claim 6 wherein said fixture is adapted to receive an ultraviolet light source.

8. An apparatus according to claim 7 which comprises a screen printing machine.

9. An apparatus according to claim 6 further comprising an actuation means, responsive to the position of an article being transported by said transportation means, for activating said first and/or second drive system to open or close said linked cover plate according to a predetermined timing program.

10. An apparatus according to claim 9 wherein said timing program comprises a sequence wherein said first cover plate begins to open, and begins to close, before said second cover plate does so.

11. An apparatus according to claim 6 wherein said cover plates comprise substantially rectangular panels slidably mounted in a single horizontal plane so as to slide in said plane toward and away from each other.

12. An apparatus according to claim 11 wherein said fixture is adapted to receive an ultraviolet light source.

13. An apparatus according to claim 6 wherein said drive systems each comprise:
- a rotary actuator mounted on said frame;
- a torque member rotatably driven by said actuator;

a drive sprocket engaging said torque member and rotated thereby;

a continuous loop drive chain engaging said drive sprocket;

one or more frame-mounted idler rollers guiding and supporting said chain; and a means for attaching said chain to said cover plate so that rotation of said drive sprocket and chain causes translation of said plate.

14. An apparatus according to claim 13 wherein each drive system further comprises: a second drive sprocket engaging said torque member; a second continuous loop chain engaging said second sprocket; a second set of frame-mounted idler rollers; and a means for attaching said second chain to said cover plate, said chains being connected to opposite sides of said cover plate.

15. An apparatus according to claim 13 wherein each drive system includes at least two idler rollers per chain.

16. An apparatus comprising:

a frame;

a fixture for holding a light source mounted to said frame;

a transportation means mounted to said frame for transporting an article into a position proximate to said fixture in which position exposure of the article to light may occur;

a cover plate slidably mounted to said frame between said fixture and said transportation means; and a drive system mounted to said frame operatively linked to said cover plate and adapted to slide said linked cover plate between an open position in which exposure may occur and a closed position in which light is blocked by said cover plate, wherein said drive system includes a rotary actuator mounted on said frame, a torque member rotatably driven by said actuator, a drive sprocket engaging said torque member and rotated thereby, a continuous loop drive chain engaging said drive sprocket, one or more frame-mounted idler rollers guiding and supporting said chain, and a means for attaching said chain to said cover plate so that rotation of said drive sprocket and chain causes translation of said plate.

17. An apparatus according to claim 16 wherein said drive system further comprises: a second drive sprocket engaging said torque member; a second continuous loop chain engaging said second sprocket; a second set of frame-mounted idler rollers; and a means for attaching said second chain to said cover plate, said chains being connected to opposite sides of said cover plate.

18. An apparatus according to claim 16 wherein said drive system includes at least two idler rollers per chain.

19. An apparatus comprising:

a frame;

a fixture for holding a light source mounted to said frame;

a transportation means mounted to said frame to transporting an article into a position proximate to said fixture in which position exposure of the article to light may occur;

a first cover plate and a second cover plate, each slidable mounted to said frame between said fixture and said transportation means; and a first drive system mounted to said frame operatively linked to said first cover plate and a second drive system mounted to said frame operatively linked to said second cover plate, each drive system adapted to slide said linked cover plate between an open position in which exposure may occur and a closed position in which light is blocked by said cover plate, said cover plates abutting each other when both are in the closed position to effectively block the light emanating from said source, wherein said drive systems each include a rotary actuator mounted on said frame, a torque member rotatably driven by said actuator, a drive sprocket engaging said torque member and rotated thereby, a continuous loop drive chain engaging said drive sprocket, one or more frame-mounted idler rollers guiding and supporting said chain, and a means for attaching said chain to said cover plate so that rotation of said drive sprocket and chain causes translation of said plate.

20. An apparatus according to claim 19 wherein each drive system further comprises: a second drive sprocket engaging said torque member; a second continuous loop chain engaging said second sprocket; a second set of frame-mounted idler rollers; and a means for attaching said second chain to said cover plate, said chains being connected to opposite sides of said cover plate.

21. An apparatus according to claim 19 wherein each drive system includes at least two idler rollers per chain.

* * * * *